United States Patent [19]

Pauwels

[11] 4,015,848

[45] Apr. 5, 1977

[54] GAME APPARATUS

[76] Inventor: Edward M. Pauwels, 2038 Hollywood Place, South Bend, Ind. 46616

[22] Filed: Feb. 2, 1976

[21] Appl. No.: 654,618

[52] U.S. Cl. ..... 273/126 R; 273/86 H

[51] Int. Cl.² ..... A63F 9/14

[58] Field of Search ..... 273/126 R, 126 A, 86 H

[56] References Cited

UNITED STATES PATENTS

| | | | |
|---|---|---|---|
| 259,327 | 6/1882 | Maxfield | 273/86 H |
| 2,093,522 | 9/1937 | Keith | 273/86 H |
| 2,311,029 | 2/1943 | Cole | 273/126 R |
| 2,641,472 | 6/1953 | Murphy | 273/86 H |
| 3,338,577 | 8/1967 | Johansson | 273/86 H |

FOREIGN PATENTS OR APPLICATIONS

| | | | |
|---|---|---|---|
| 5,182 | 12/1908 | United Kingdom | 273/126 R |

*Primary Examiner*—William H. Grieb

[57] ABSTRACT

A game apparatus having an annular play surface with a plurality of indicator play pieces thereon. A shaft is fixed in the center of the play surface. A boom is pivotally attached to the shaft. A cam member is resiliently retained in a stationary position on the shaft adjacent the boom. An arm member is located on the end of the boom over the play surface. A follower attached to the boom member is resiliently biased against the cam member. An actuator in response to an operator rotates the boom around the shaft causing the arm member to follow a determinable irregular path over the play surface and preferably move at least one of the play pieces from a first position to a second position.

11 Claims, 14 Drawing Figures

22
31
35
33
50
80
86
72
76
84
88(a)
177
170
176
172
174
78
104
70
64
66
300
304
338
342
40
94
98
102
111
113
13
74
67
344
332
334
60
336
38
330
320
324
322
328
308
326
316
312
318
310
314
42
115
340
338
300
304
62
54
56
58
320

GAME APPARATUS

BACKGROUND OF THE INVENTION

Game apparatus have always had the goal of testing the skill of the players involved. The skill of the operator in the known prior art has varied from the ability of turning a crank faster than an opposing player as illustrated in U.S. Pat. No. 259,327, to the selection of various gear and ratchet arrangement typically illustrated in U.S. Pat. No. 2,093,522. In all of the known prior art, the play pieces associated with the game apparatus are aligned on a play surface in a slot, each play piece being normally carried on an arm, and as shown in U.S Pat. Nos. 367,186 and 3,338,577, always aligned on the same radii from the center of the play surface. Unfortunately, the ability to win is more luck than skill. Therefore, after several games most players lose interest in these games.

SUMMARY OF THE INVENTION

I have devised a game apparatus wherein each player involved has an indicator piece positioned on a play surface. Each indicator piece is moved from a starting position to a finish position through a series of engagements with a face of a head member carried by a boom means. The boom means is rotated around a fixed shaft by an actuator means responsive to an operational input from an operator. The head member is connected to a cam surface which is frictionably positioned in a stationary location on the shaft. When the boom means is rotated around the shaft, the head member follows an irregular path corresponding to the shape of the cam surface and so advance any indicator piece with which it comes into contact. By selectively adjusting or selecting a different cam member a player can propel his indicator piece from the start position to the finish position.

It is therefore the object of this invention to provide a game apparatus wherein a player can propel an indicator piece on a play surface through the engagement of an arm means which travels in an irregular path over the play surface.

It is another object of this invention to provide a game apparatus with a boom means responsive to an input from a first player for moving an indicator piece from a first position to a second position, the boom means following the path of an adjustable cam surface to move the operator's play piece without advancing the play piece of an opposing player.

It is a still further object of this invention to provide a game apparatus having a boom means with an arm means which moves along an irregular path over a play surface. The arm means has a guide means to maintain indicator pieces on a play surface when the boom means is rotated from a start position to a finish position.

It is another object of this invention to provide a game apparatus with adjustable cam means for moving a head member attached to a rotating boom means in an irregular three dimensional path over a play surface and avoid moving an opponent's indicator piece from a first location to a second location.

These and other objects of this invention will become apparent from reading this specification and viewing the drawings.

DETAILED DESCRIPTION OF THE PREFERRED EMBODIMENT

Figure 1:
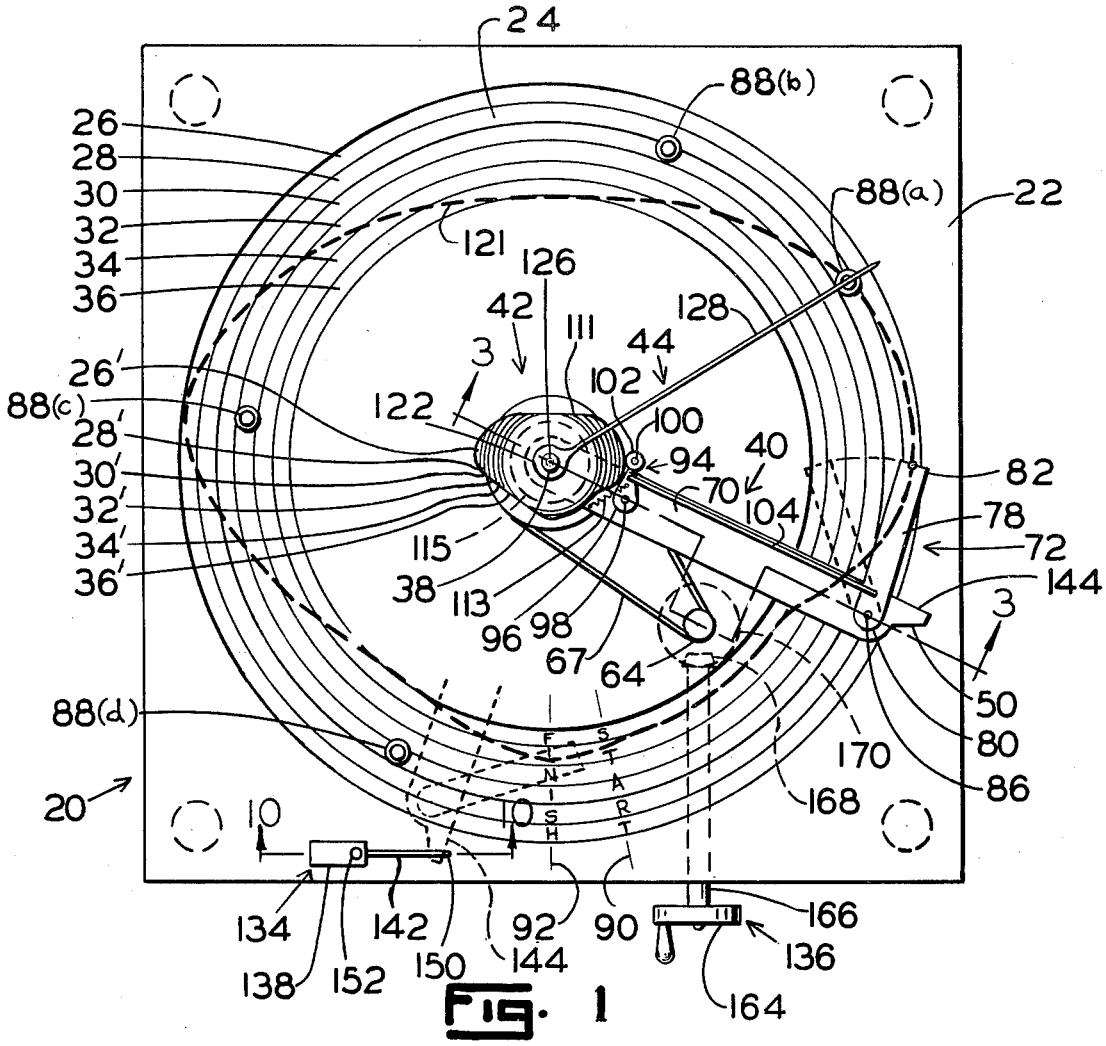
FIG. 1 is a plan view of a game apparatus having a boom means for selectively propelling indicator play pieces from a start position to a finish position.
Figures 3, 4:
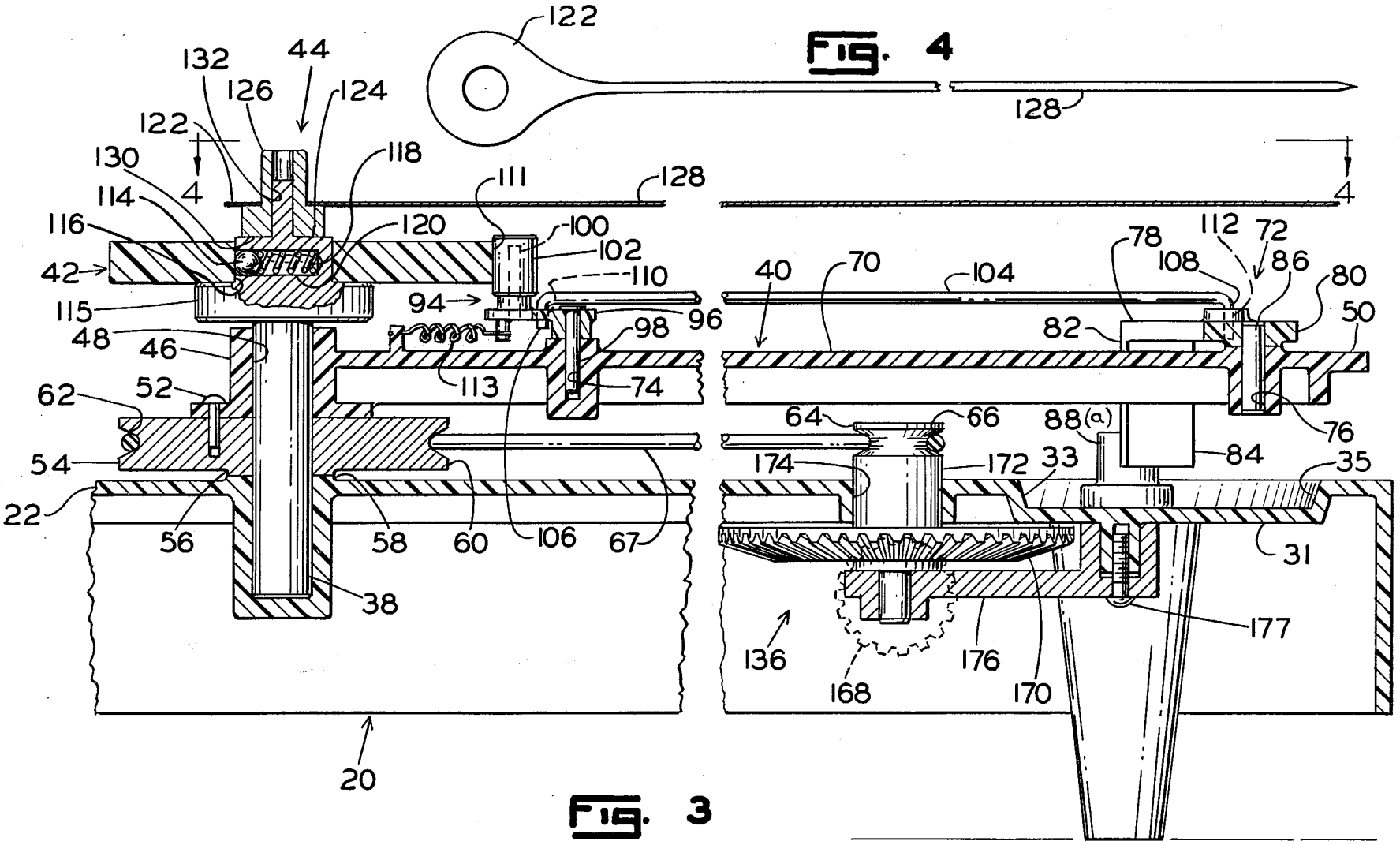
FIG. 3 is a sectional view of the actuator for rotating the boom means of FIG. 1, taken along line 3—3.
FIG. 4 is a plan view of a pointer for use with the indicator pieces to align the cam means in order to provide selected engagement with the head on the boom means with each rotation.

The game apparatus 20 shown in FIG. 1 has a housing 22 with a play surface 24 located thereon. The play surface 24 has a series of concentric lanes 26, 28, 30, 32, 34 and 36. Each of the lanes are on a fixed radius from an axial shaft 38. The lanes 26, 28, 30, 32, 34 and 36 as shown in FIG. 3 are located in a depressed section 31. The walls 33 and 35 retain the indicator pieces **88*a*, 88*b*, 88*c* and 88*d* within the play surface 24. The shaft 38 is fixed to the housing 22. The shaft 38 retains a boom means 40, a cam means 42 and a pointer means 44 in a fixed location on the play surface 24**.

Figure 2:
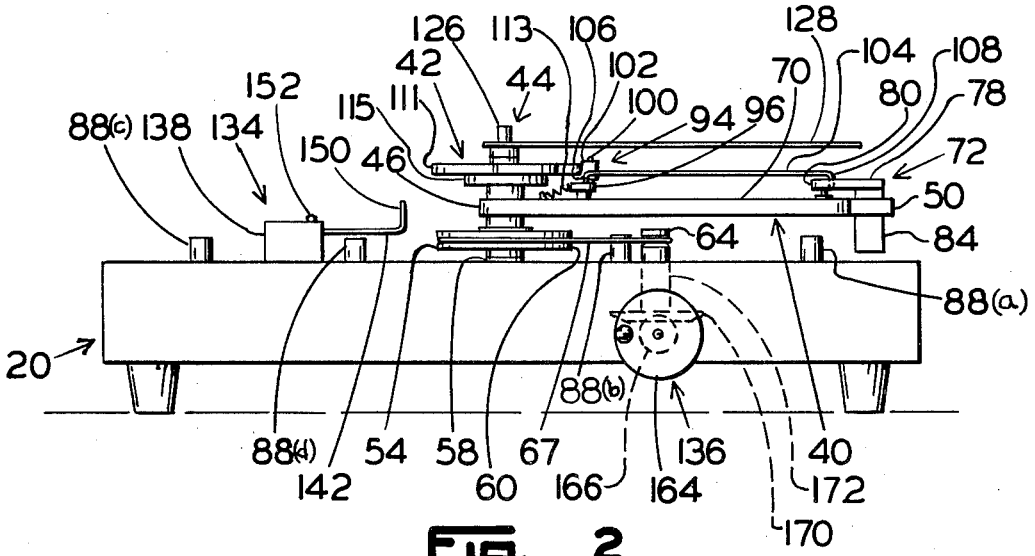
FIG. 2 is a front elevation view of the game apparatus in FIG. 1.

The boom means 40 has a first end 46 with a bore 48 (see FIGS. 2 and 3) therein for providing a bearing surface for engaging the shaft 38 and a second end 50 which overlies the play surface 24. A fastener 52 connects the first end 46 with a sheave or pulley means 54. A shoulder 56 on the pulley means 54 rests on a shoulder 58 on the housing 22. The height of the shoulder 58 can be varied in order to align the groove 62 in the peripheral surface 60 of the sheave or pulley means 54 with a groove 66 in a driver sheave or pulley means 64. A belt 67 or any other transmission means such as a series of gears connects the drive pulley 64 with the pulley means 54.

The boom means 40 has a rectangular member 70 which joins the first end 46 with the second end 50. The rectangular member 70 has a first pivot bore 74 and a second pivot bore 76 approximately in a radial line with the center of the axial shaft 38.

An arm means 72, located adjacent the second end 50 of boom means 40, has a strap member 78 with a first end 80 with a flat surface and a second end 82 with a leg 84 extending toward the play surface 24. The first end 80 has a pin 86 extending therethrough into the second pivot bore 76. The length of the leg 84 is such that a play piece 88*a*, 88*b*, 88*c* or 88*d* can be contacted upon rotation of the boom means 40 from a start position 90 to a finish position 92.

A follower means 94 has a crank shaped body 96 with a first pin 98 located in the first pivot bore 74 on the rectangular member 70 of the boom means 40, and a second pin 100. A roller 102 is located on the second pin 100.

A linkage member 104 has a first leg 106 located in the bore 110 in the crank shaped member 96 and a second leg 108 located in the bore 112 in the strap member 78 to connect the follower means 94 with the arm means 72. A parallelogram is formed between the rectangular member 70, the crank shaped body 96, the linkage member 104 and strap 78 for aligning the leg 84 of the arm means 72 with the cam means 42 when spring or resilient means 113 holds the roller 102 against the peripheral surface 111 of cam 42. The spring 113 which is connected to the rectangular body 70 and the crank shaped body 96 has sufficient strength to cause the follower-means 94 to pivot about pin 98 and maintain the roller 102 in constant contact with the peripheral surface 111 during the rotation of the boom means 40 from the start position 90 to the finish position 92.

Figure 7:
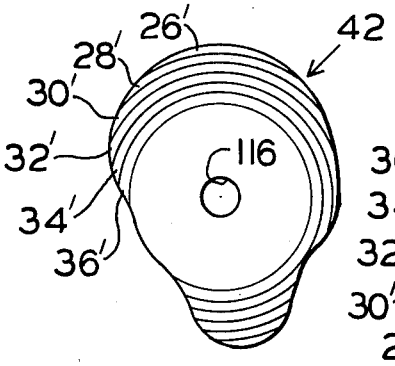
FIGS. 7, 8 and 9 are plan views of various cam means for use in the game apparatus of FIG. 1 for changing the irregular path traversed by the head means over the play surface.
Figure 8:
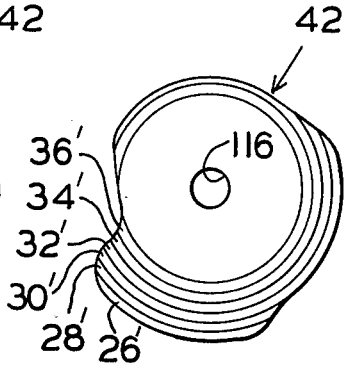
Figure 9:
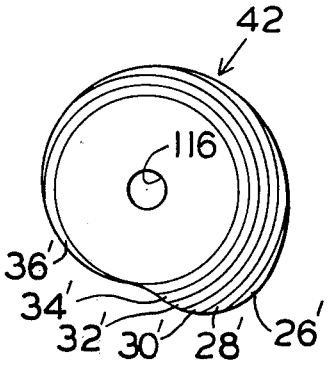

The position of the peripheral surface 111 on the cam means 42 with respect to the start position 90 can be varied since the cam means 42 is retained on shoulder 115 by ball 114 being held in bore 116 by spring 118 located in cross bore 120 in shaft 38. The cam means 42 has concentric lanes 26', 28', 30', 32' 34' and 36' located thereon corresponding to lanes 26, 28, 30, 32, 34 and 36 on the play surface 24. Leg 84 of the arm means 72 follows on irregular path 121 around the play surface 24 during a revolution of the boom means 40 from the start position 90 to the finish position 92. In addition the irregular path of the leg 84 on the arm means 72 can also be changed by the selection of another cam means 42 as illustrated in FIGS. 7, 8 and 9. Thus an operator can advance an indicator piece 88*a*, 88*b*, 88*c* or 88*d* from a first position to a second position without moving an indicator piece of an opposing player. The shoulder 115 maintains the peripheral surface 111 in a plane substantially parallel to roller 102.

The pointer means 44 has an eye member 122, see FIG. 4, which is fixed on knob 126. The knob 126 has a face 130 which sits on shoulder 124 on the shaft 38. The shoulder 124 holds the shaft 128 of the pointer means 44 out of contact with the end of roller 102. Bore 132 in knob 126 allows pointer means 44 to be freely rotated around shaft 38 to align a selected indicator play piece 88*a*, 88*b*, 88*c* or 88*d* with the appropriate lane 26', 28', 30', 32', 34' or 36' on cam means 42.

Figure 10:
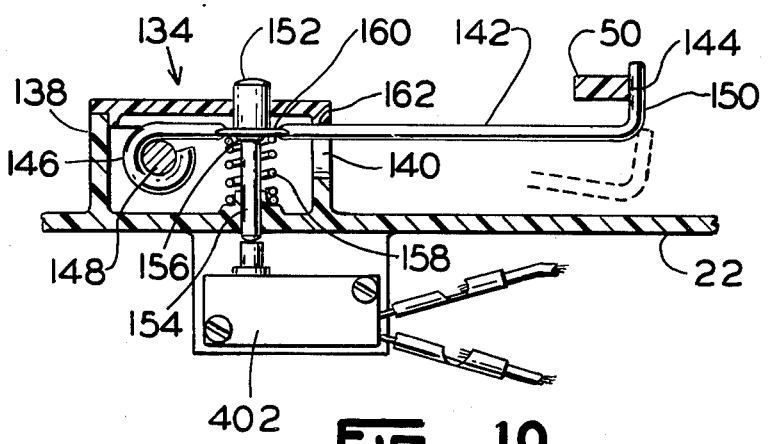
FIG. 10 is a sectional view taken along line 10—10 of FIG. 1 showing a latch means for releasing the boom means from a start position.

The rotation of the boom means is initiated by the release of latch means 134, best seen in FIG. 10, which allows an actuator or motor means 136 to supply a rotative torque to driver pulley 64.

The latch means 134 has a housing 138 which is attached to the housing 22. The housing 138 has a slot 140 though which lever 142 extends for engagement with face 144 on the second end 50 of the boom means 40, shown in FIG. 1 in phantom, when the boom means 40 is in the rest position.

The lever 142 has an eye 146 located on a first end which is positioned on pin 148. The pin 148 is secured to the housing 138. The lever 142 has a hook 150 located on a second end. The hook 150 is adapted to be moved out of engagement with face 144 by depressing button 152 on stem 154. Stem 154 has a shoulder 156 which holds hook 150 on lever 142 in a vertical position with respect to play surface 24. A spring 158 located between the housing 22 and washer shaped surface 160 on the lever 142 holds the lever 142 against stop 162 in order that face 144 of the hook 150 will engage end 50 on the boom means 40 after a single revolution around shaft 38.

The motor means 136 shown in FIG. 1 has a crank 164 which is connected to shaft 166 for transmitting a rotational torque to gear 168. Gear 168 transmits rotary torque into gear 170 attached to shaft 172. Shaft 172 is held in bearing surface 174 of the housing 22 by support bracket 176. The support bracket 176 is secured to housing 22 through one or more fasteners 177 to maintain driver sheave or pulley 64 in alignment with sheave or pulley means 54.

MODE OF OPERATION OF A PREFERRED EMBODIMENT

The object of this game is for a player to move an assigned indicator piece 88*a*, 88*b*, 88*c* or 88*d* from a start position 89 to a finish line or position 92 before another player moves his assigned indicator piece around the play surface 24. After the rotation of the players has been determined, a player begins his turn by selecting a cam means 42 for moving his indicator piece, for instance 88*a*, around the play surface 24 without correspondingly moving the indicator pieces 88*b*, 88*c* or 88*d* of other players. After the cam means 42 has been aligned button 152 is depressed to release face 144 from engagement with hook 150 to allow the operator to spin crank 164 and supply driver pulley 64 with a rotative torque. Rotative torque from the driver or pulley means 64 is transmitted through belt 67 into pulley means 54 to rotate the boom means 40 around shaft 38. When boom means 40 rotates around shaft 38, roller 102 on the follower means 94 follows the contour of the peripheral surface 111 on the cam means 42. Radial movement of the roller 102 with respect to the shaft 38, is transmitted through linkage member 104 to move arm means 72 and leg 84 on an irregular path with respect to the play surface 25, as iilustrated by phantom line 121.

At the end of a revolution, hook 150 again engages face 144 and holds the boom means 40 stationary in a precise radial location. Any further rotation of crank 164 by this player does not rotate the boom means 40 as belt 67 is adapted to slip. Thereby, the drive means 136 is not harmed from additional rotative torque.

After each player has had a turn, the game becomes more complicated since the cam means 42 must now be selected to advance a player's own indicator piece 88*a*, 88*b*, 88*c* or 88*d* without unduly moving an opposing player's indicator piece. To aid in selecting the peripheral surface 111 which will aid the player the most, shaft 128 of pointer means 44 is aligned with the indicator piece 88, as shown in FIG. 1, and the peripheral surface 111 on the cam means 42 is moved on the shaft 38 to provide the most advantageous path for leg 84 to advance the indicator piece 88 from a first position to a second position.

Each player takes his turn and the first player whose indicator piece 88 crosses the finish position 92 is the winner of the game.

Figures 5, 6:
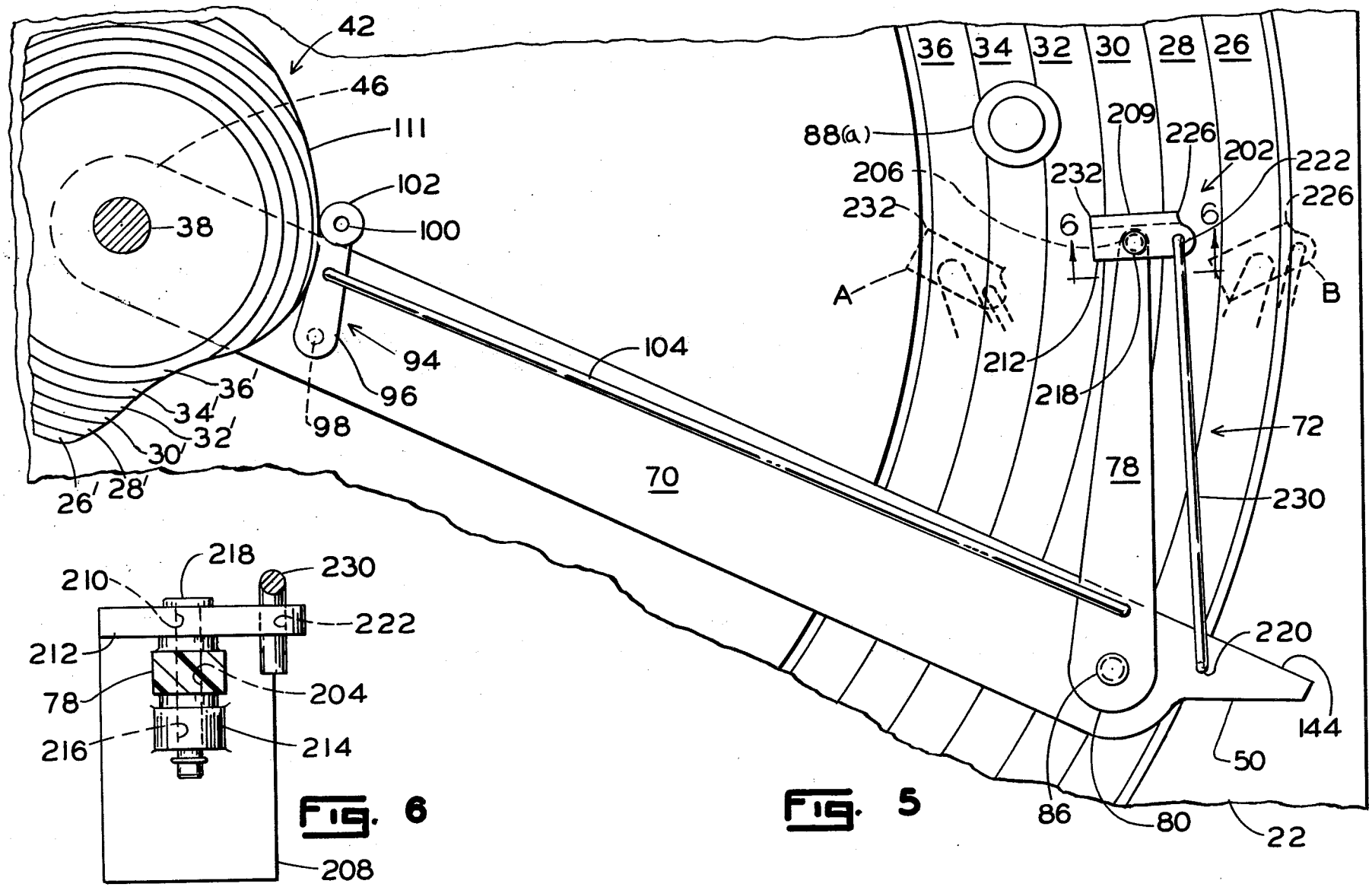
FIG. 5 is a plan view of a boom means for use in the game apparatus of FIG. 1, having a guide means for retaining the indicator pieces on the play surface.
FIG. 6 is a sectional view taken along line 6—6 of FIG. 5 showing the pivotal relationship of the head means on the arm means attached to the rotatable boom.
Figure 11:
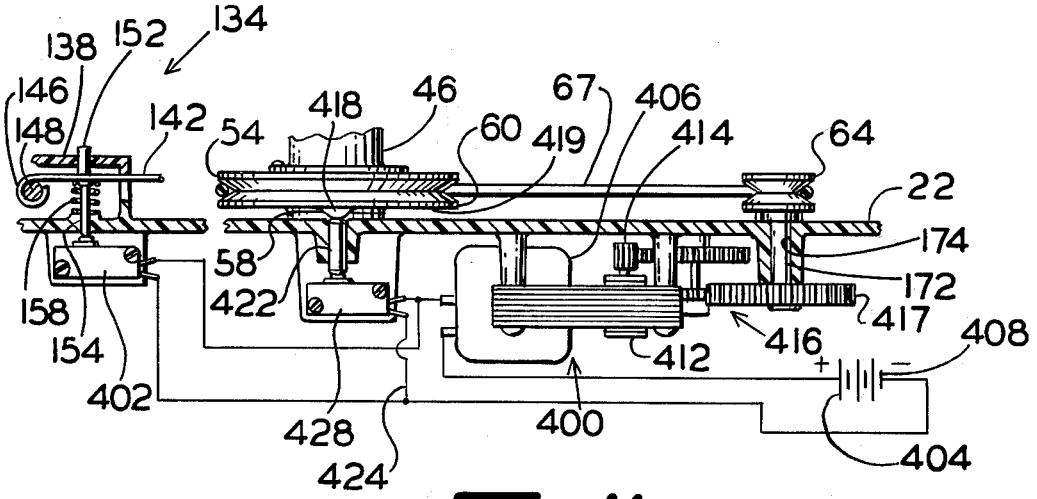
FIG. 11 is a sectional view of an electrical motor means for rotating the boom means of FIG. 1.
Figures 12, 13, 14:
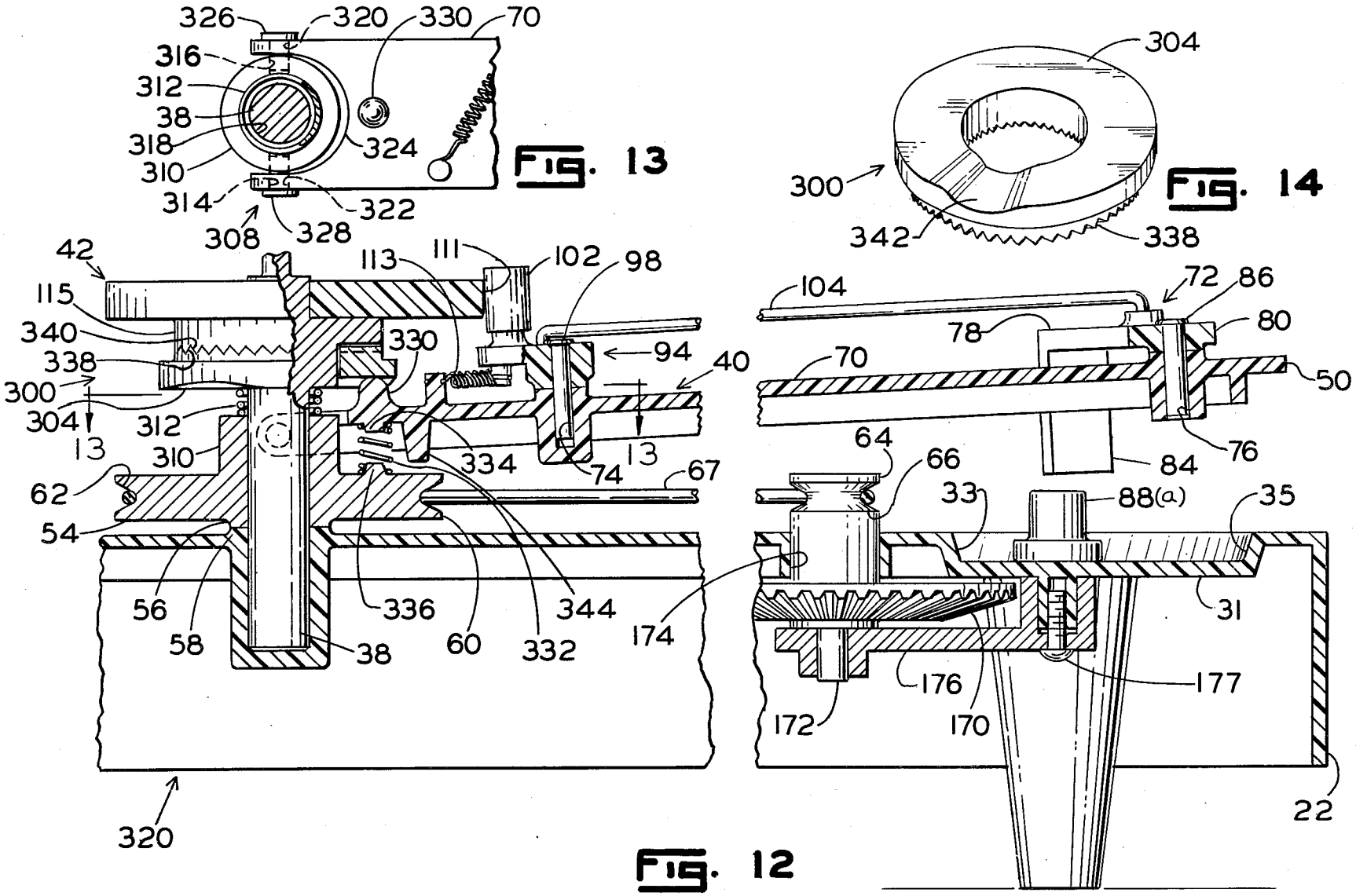
FIG. 12 is a sectional view of a game apparatus showing a plurality of cam means for moving the face on the boom means on a selected three dimensional path over the play surface.
FIG. 13 is a plan view showing a pivotal means through which the boom means is moved in a perpendicular path with respect to the play surface.
FIG. 14 is an inverted view of an adjustable vertical cam utilized in FIG. 12.

In the embodiments shown in FIGS. 5, 11 and 12, wherein like elements are the same as FIG. 1, the same reference numerals will be used.

In FIG. 5 an articulated leg means 202 is adapted to prevent indicator pieces 88, as they are urged forward, from adhering to side walls 33 and 35 of the play area 24. If desired, walls 33 and 35 could now be eliminated making play surface 24 level with top surface of housing 22. The strap member 78 of arm means 72 has a bore 204 adjacent a second circular end 206, see FIG. 6. The leg 208 has a first projection 212 and a second projection 214. The first projection 212 has a first hole 210 and the second projection 214 has a hole 216 located therein at substantially the center of the face 209. The first projection 212 has a third hole 222 located on a line at a right angle from the end 226 of the face 209. A pin 218, see FIG. 6, extends through the first projection 212, bore 204 in strap 78 and the second projection 214 to attach the leg 208 to the end of the strap 78. The boom means 40 has a hole 220 located adjacent the second end 50. A linkage rod 230 has a first leg located in the hole 220 of the boom means 40 and a second leg located in hole 222 to form a parallelogram with the strap 78. Thus, as roller 102 moves around the peripheral surface 111 of the cam means 42, arm means 72 is moved from the lane 36 to lane 26, and face 209 moves from an angle where the edge 232 is leading, as shown in phantom A, to an angle where edge 226 is leading, as shown in phantom B. Whenever an indicator piece 88*a*, 88*b*, 88*c* or 88*d* engages face 209, it is moved toward the center of the play surface 24.

In the embodiment shown in FIG. 12, a vertical cam means 300 has been added to the game apparatus 20. Now the second end 50 of the boom means 40 follows a contour illustrated in FIG. 14 by surface 304 on the second cam means 300. In order for the second end 50 of boom means 40 to move vertically with respect to the play surface 24, hinge means 308 is provided on hub member 310 of the sheave or pulley means 54. The hub member 310 has a first bore 314 and a second bore 316 located at a right angle to axial bore 318 through which shaft 38 is positioned. The boom means 40 has a first hole 320 located opposite a second hole 322. A circular cutout 324 extends from the edge of holes 320 and 322 to allow rectangular member 70 to pivot about pins 326 and 328. A projection 330 extends from the center of the rectangular member 70.

Spring 332 caged between guides 334 and 336 biases the projection 330 into constant engagement with irregular surface 304 on the second cam means 300.

The second cam means 300, shown in FIG. 14 in an inverted position, has serrations 338 which engage corresponding serrations 340 on the shoulder 115 on the first cam means 42. The position of the indentation or irregular surface 342 can be adjusted by pushing the second cam means 300 down by compressing springs 312 and 332, sufficient to disengage the serrations 338 from serrations 340. Thereafter, the second cam 300 is rotated to a desired position. A projection 344 on boom means 40 limits downward movement of cam means 300 to prevent damage to arm means 72.

When the embodiment of the game apparatus 20, shown in FIG. 12 is utilized, the leg 84 moves along a three dimensional irregular path around the play surface 24. The second cam means 300 allows a player to jump the indicator piece 88*a*, 88*b*, 88*c* or 88*d* of an opposing player without advancing the same from a first position to a second position. Thus, each player can selectively adjust the first cam means 42 and the second cam means 300 so that preferably only his own indicator piece 88 is advanced during a revolution of the boom means 40 around the shaft 38.

In the embodiment shown in FIG. 11, I have adapted an electric motor means 400 for providing the driver pulley or sheave means 64 with rotative torque. The stem 154 of the latch means 134 extends through the housing 22 and activates a first switch 402 to allow current to flow from a source 404 through coil 406 to ground 408. With current flowing in coil 406, rotor 412 inputs a rotative torque to gear 414. The rotative torque of gear 414 is transmitted through the reduction gears means 416 before being communicated to gear 417 on shaft 172 on the pulley means 64.

When the pulley means 54 is rotated from the start position 90, projection 418 on the peripheral face 419 of pulley or sheave means 54 moves out of contact with plunger 422 to allow a second switch 428 to close and complete the electrical circuit from the source 404 through lead 424. Thereafter, the button 152 of the first switch 402 can be released and the coil 406 remains energized. When the pulley means 54 has been rotated a complete revolution, projection 418 again engages plunger 422 to interrupt the flow of current from the source 404 and de-energize the motor means 400. At approximately the same time, hook 150 engages face 144 and prevents any inertia in the motor means 400 from rotating the leg 84 past the starting point 90. In this embodiment, the player can concentrate on the selection of the proper cam means 42 for only moving his own indicator piece 88 without expending energy manually rotating the pulley means 64.

I claim:

1. A game apparatus comprising:

a housing;

shaft means secured to said housing;

boom means having a first end pivotally located on said shaft means and a second end extending over a play surface, said play surface having a plurality of indicator pieces located therein;

cam means positioned on said shaft means adjacent said boom means;

follower means pivotally located on said boom means;

resilient means for biasing said follower means into continual engagement with said cam means;

arm means attached to said second end of the boom means and adapted to contact said indicator pieces;

linkage means for connecting said arm means to said follower means; and actuator means responsive to an operator input for rotating said boom means around said shaft means causing said follower means to follow said cam means and move said arm means in irregular path over said play surface to preferably advance at least one of said plurality of indicator pieces from a first position to a second position during a cycle of revolution of said boom means around said shaft.

2. The game apparatus, as recited in claim 1, wherein said cam means includes fastener means connected to the shaft means to allow the operator to reposition the peripheral surface of the cam means and thereby change the irregular path that the arm means travels over the play surface.

3. The game apparatus, as recited in claim 2, wherein said arm means includes:

guide means pivotally attached to said boom means and said arm means for aligning the face of the arm means with respect to the peripheral surface of the cam means to maintain the indicator pieces on said play surface.

4. The game apparatus, as recited in claim 2, wherein said shaft means includes:

shoulder means for maintaining said cam means in a plane parallel to said play surface.

5. The game apparatus, as recited in claim 2, wherein said shaft means includes:

second cam means having an irregular surface with respect to said play surface; and spring means for holding said boom means against said irregular surface causing said second end of the boom means to move toward and away from said play surface during said cycle of revolution to allow said arm means to avoid contact with a selected number of said plurality of indicator pieces.

6. The game apparatus, as recited in claim 4, wherein said actuation means includes:

latch means connected to said housing for releasing said boom means from a start position during said cycle of rotation.

7. The game apparatus, as recited in claim 4, wherein said actuator means includes:

crank means connected to said housing; and transmission means connected to the crank means, said transmission means allowing the operator to impart a torque to rotate the boom means.

8. The game apparatus, as recited in claim 6, wherein said actuator means further includes:

motor means secured to said housing; and transmission means connected to said motor means, said motor means being responsive to the operator to provide the boom means with a rotative torque.

9. The game apparatus, as recited in claim 8, wherein said actuator means further includes:

switch means secured to said housing and engaged by a second cam means on said boom means to interrupt the operation of said motor means when said boom means approaches the finish position in the cycle of rotation.

10. The game apparatus, as recited in claim 6, wherein said latch means includes:

bumper means for stopping said boom means at a finish position to prevent the boom means from rotation through inertia past said second position after interruption of the operation of the motor means.

11. The game apparatus, as recited in claim 1, further including:

pointer means for aligning the cam means with one of said plurality of indicator pieces to provide movement of the selected indicator piece during each rotation of the boom means.

* * * * *